United States Patent [19]

Günthner et al.

[11] Patent Number: 4,770,100

[45] Date of Patent: Sep. 13, 1988

[54] HOLLOW CHARGE SUBSIDIARY PROJECTILE INCLUDING A PROJECTILE BODY AND A FUZE SPACER AT THE FRONT

[75] Inventors: Friedhelm Günthner, Neuss; Ernst-Wilhelm Altenau, Duisburg, both of Fed. Rep. of Germany

[73] Assignee: Rheinmetall GmbH, Düsseldorf, Fed. Rep. of Germany

[21] Appl. No.: 74,252

[22] Filed: Jul. 16, 1987

[30] Foreign Application Priority Data

Jul. 18, 1986 [DE] Fed. Rep. of Germany ..... 3624330

[51] Int. Cl.[4] ..... F42B 11/22

[52] U.S. Cl. ..... 102/476

[58] Field of Search ..... 102/476, 306–310, 102/210, 216, 397

[56] References Cited

U.S. PATENT DOCUMENTS

| | | | |
|---|---|---|---|
| 2,393,275 | 1/1946 | Whitesell, Jr. . | |
| 2,458,576 | 1/1949 | Etten . | |
| 3,804,020 | 4/1974 | Norton | 102/397 |
| 3,838,644 | 10/1974 | Prochnow et al. | 102/476 |
| 4,620,483 | 11/1986 | Simpson | 102/216 |
| 4,669,386 | 6/1987 | Precoul et al. | 102/476 |

FOREIGN PATENT DOCUMENTS

| | | | |
|---|---|---|---|
| 2478297 | 3/1980 | France . | |
| 2455802 | 1/1981 | France | 102/476 |

*Primary Examiner*—Harold J. Tudor

*Attorney, Agent, or Firm*—Spencer & Frank

[57] ABSTRACT

The projectile body of a hollow charge subsidiary projectile is configured of a helical wire which forms a closed wall in that mutually adjacent wire turns are connected together in common contracting regions. A given number of wire turns at the front of the projectile body beginning in the vicinity of the base of the hollow charge insert remain unconnected so that a spring-like detonator spacer results which is delimited at the front by the last wire turn.

8 Claims, 1 Drawing Sheet

PRIOR ART

HOLLOW CHARGE SUBSIDIARY PROJECTILE INCLUDING A PROJECTILE BODY AND A FUZE SPACER AT THE FRONT

BACKGROUND OF THE INVENTION

The present invention relates to a hollow charge subsidiary projectile. More particularly, the present invention relates to hollow charge subsidiary projectile of the type including a projectile body containing a shaped charge and having a frontal detonator spacer which can be brought into a space saving transporting position against the resetting force of a helical spring and is able to return from the transporting position, after the projectile has been ejected from a carrier projectile, into an active position in which a favorable stand-off of the projectile is ensured.

A hollow charge subsidiary projectile of this type is disclosed in German Pat. No. 2,242,930, corresponding to U.S. Pat. No. 3,838,644 issued Oct. 1st, 1974. Such a projectile can be stacked to form a column-like structure. To be able to take up a space-saving transporting position, the detonator spacer has the shape of a tube which can be pushed axially over the exterior of the projectile body against the resetting force of a helical spring, e.g. a torque biased or compression spring. This prior art hollow charge subsidiary projectile meets the highest requirements. However, since it is composed of numerous individual parts, it is disadvantageously expensive and cumbersome with respect to logistics.

SUMMARY OF THE INVENTION

Consequently, it is an object of the invention to provide a hollow charge subsidiary projectile of the above-mentioned type which is additionally composed of comparatively fewer individual parts and thus permits simplified manufacture.

The above object is achieved according to the present invention in that in a hollow charge subsidiary projectile including a projectile body containing a shaped charge having a charge insert with a base adjacent the front end of the body, and a detonator spacer disposed at the front of and connected to the body such that the detonator spacer can be retracted into an axial space saving transporting position against the resetting force of a spring and is able to return, after the subsidiary projectile has been ejected from a carrier projectile, into an active position in which a favorable stand-off of the front end of the body is ensured; the projectile body is composed of at least one layer of a helically wound wire with a given number of adjacent wire turns contacting one another and being connected with one another in predetermined regions so as to form a closed wall constituting the projectile body; and the detonation spacer is formed by a further given number of adjacent wire turns of the at least one layer of helically wound wire which are disposed in a region extending forward from a position adjacent the base of the charge insert, which remain unconnected and which are normally axially spaced, and with the spacer being delimited at the front of the projectile by the last free wire turn of the further given number of wire turns, whereby the further given number of wire turns act as a spring which can be compressed to bring the spacer into the transporting position.

According to features of the invention, the wire of the at least one helically wound layer has a rectangular cross-section, the one layer forms the outer peripheral surface of the projectile body, and the interior of the spacer and of the insert are shaped and dimensional such that they can accommodate at least a portion of the rear end of a further subsidiary projectile of like shape.

The invention will be described in greater detail below in connection with a preferred embodiment with reference to the drawings.

BRIEF DESCRIPTION OF THE DRAWINGS

In the illustrations of FIGS. 2 and 3, all details not significant for the invention have been omitted and in all three figures the same reference numerals have been employed, where possible, to indicate corresponding structures or elements.

DETAILED DESCRIPTION OF THE PREFERRED EMBODIMENT

Figure 1:
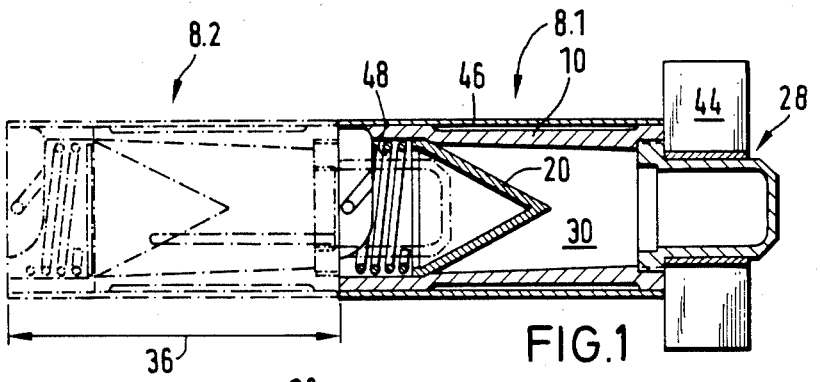
FIG. 1 is a schematic longitudinal axial view, partially in section, of a stack of two hollow charge subsidiary projectiles according to the prior art.

As shown in FIG. 1, two prior art hollow charge subsidiary projectiles 8.1 and 8.2 (the latter shown in dot-dash lines and not completely provided with reference numerals) according to the above cited U.S. Patent are arranged in a nested manner to form a column-like stack. Each hollow charge projectile generally includes a cylindrical projectile body 10 having a hollow shaped explosive charge 30 with a hollow charge insert 20 disposed therein, with the insert 20 opening toward the front of the projectile body 10. Secured to the rear end of the projectile body 10 is a fuze or detonator housing 28. Fastened to the exterior of the detonator housing 28 is a simple and space saving guide mechanism including a plurality of hinged vanes or fins 44 which can be folded inwardly around the circumference of the detonator housing 28. Disposed in a portion of the projectile body 10 which extends forwardly of the frontal or base plane of the hollow charge insert 20 is a helical spring 48 which is connected between the projectile body 10 and a detonator spacing tube 46 which surrounds the body 10 in a telescoping manner and which in the active position (not shown) of the projectile, i.e., after it has been ejected from a carrier projectile, extends forwardly of the body 10 by a predetermined amount. The inner dimensions of the front open end of the body 10 and of the spring 46 are such that they can accommodate the outer dimensions of the detonator housing 28 with the folded stabilizing vanes or fins 44 of the stabilizing mechanism.

For the space saving transporting position shown in FIG. 1, the fuze spacing tube 46 of projectile 8.1 has been pushed rearward or axially retracted over projectile body 10 against the resetting force of the helical spring 48. Thus, the hollow charge subsidiary projectile 8.2, minus the length of the detonator housing 28 which is accommodated within the front end of hollow charge subsidiary projectile 38.1, partially in the cavity of the hollow charge insert 20 as shown, has a length 36 is the transporting position, which length 36 is substantially less than its length in the active position.

Figure 2:
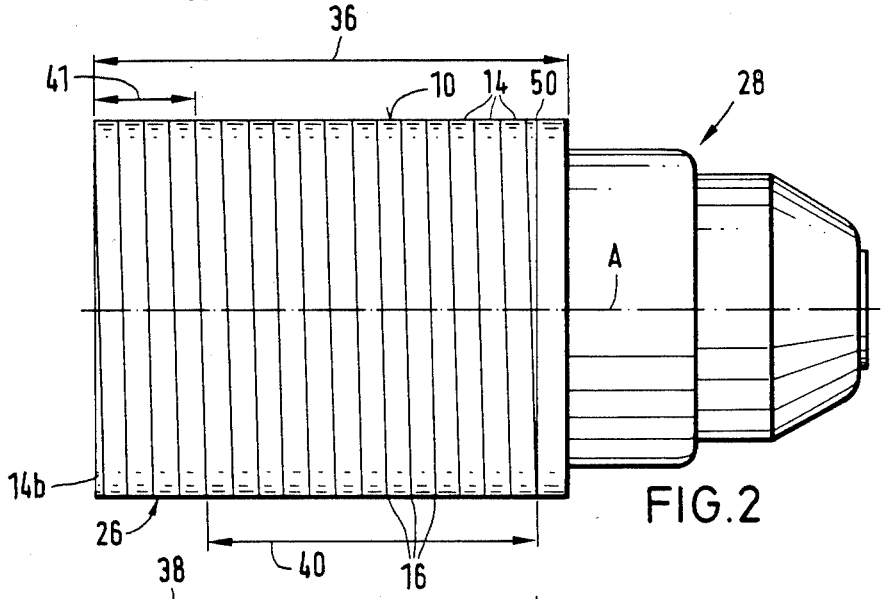
FIG. 2 is a side elevation view of a hollow charge subsidiary projectile according to the invention in the transporting position.
Figure 3:
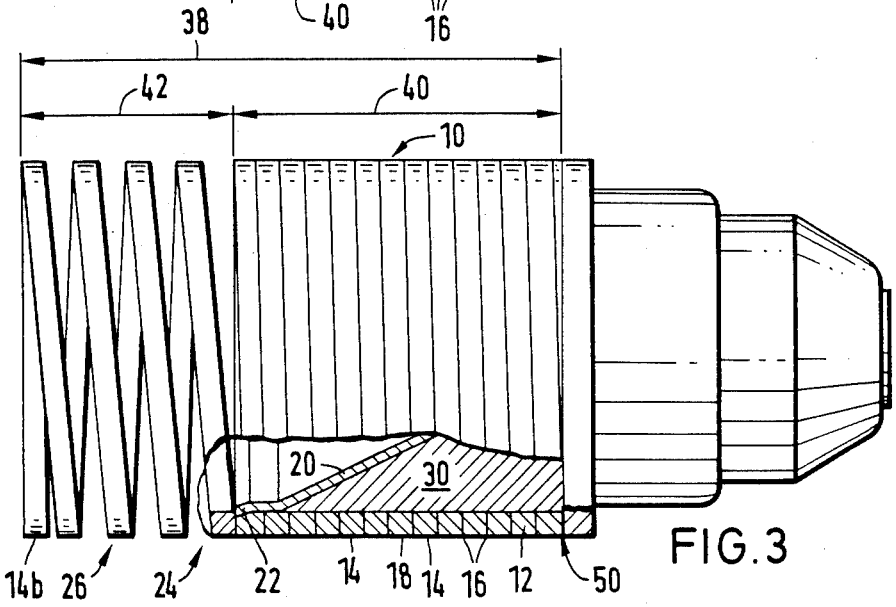
FIG. 3 shows the hollow charge subsidiary projectile of FIG. 2 in the active position, with part of it broken away for the sake of clarity.

The hollow charge subsidiary projectile according to the invention of FIGS. 2 and 3 can also be stacked in a nested manner in that the detonation housing 28 with the folded vanes 44 can be accommodated in the interior of the front end of the body 10 in a manner similiar to that shown in FIG. 1. In FIGS. 2 and 3, for reasons of clarity, details known from FIG. 1, for example the vanes 44 of the stabilization mechanism, are no longer shown separately.

As shown in FIGS. 2 and 3, the projectile body 10 is formed from a given number of adjacent turns 14 of a helically wound wire 12, preferably having a rectangular cross section as illustrated, which are positioned so that they contact one another and which are connected with one another only in the indicated regions 16 over the length 40. The connection may be done by welding, soldering or gluing. Thus, the portion of wire 12 forming the projectile body 10 presents a closed cylindrical wall 18 which contains the shaped charge 30 with its insert 20. The rear end of projectile body 10 is connected with the detonator housing 28 in the indicated region 50. The closed wall 18 of projectile body 10 has the length 40, with the frontal limitation being essentially given by the base plane 22 of the hollow charge insert 20. Beginning in the region 24 adjacent and forward of the base plane 22, the remaining given number of turns 14 of wire 12 are no longer connected with one another and are normally axially spaced as shown in FIG. 3. In this way, a compression spring is produced which acts as the detonator spacer 26. The formation of the projectile body 10 (wall 18) and the spacer 26 is carried out in a single process step and without requiring an additional part.

When in the compressed state for the transporting position, spacer 26 (see FIG. 2) has only a short length 41, and body 10 and spacer 26 have a total length 36. The last turn **14*b* the helical wire coil defines the outer limitation of the cylindrical spacer 26 and thus of the projectile. In the active position (see FIG. 3), the body 10 and spacer 26 have a total length 38, which is greater than length 36 since the spacer length 42, which is greater than the compressed spacer length 41, has now been added to the constant length 40 of body 10**.

The illustrated embodiment shows only a single layer of the helically wound wire 12. It is understood that several wire helixes can be pushed tightly into one another, in which case, for reasons of saving space, only the outer wire helix is used to form the detonator spacer 26.

It will be understood that the above description of the present invention is susceptible to various modifications, changes and adaptations, and the same are intended to be comprehended within the meaning and range of equivalents of the appended claims.

What is claimed is:

1. In a hollow charge subsidiary projectile including a projectile body containing a shaped charge having a charge insert with a base adjacent the front end of said body, and a detonator spacer disposed at the front of and connected to said body such that said detonator spacer can be axially retracted into a space saving transporting position against the resetting force of a spring and is able to return, after said subsidiary projectile has been ejected from a carrier projectile, into an active position in which a favorable stand-off of said front end of said body is ensured; the improvement wherein:

said projectile body is composed of at least one layer of a helically wound wire with a given number of adjacent wire turns contacting one another and being connected with one another in predetermined regions so as to form a closed wall constituting said projectile body; and said detonation spacer is formed by a further given number of adjacent wire turns of said at least one layer of helically wound wire which are disposed in a region extending forwardly from a position adjacent said base of said charge insert, which remain unconnected and which are normally axially spaced, said spacer being delimited at the front of said projectile by the last free wire turn of said further given number of wire turns, whereby said further given number of wire turns act as a spring which can be compressed to bring said spacer into said transporting position.

2. A hollow charge subsidiary projectile as defined in claim 1 wherein said wire of said at least one helically wound layer has a rectangular cross-section.

3. A hollow charge subsidiary projectile as defined in claim 1 wherein said one layer forms the outer peripheral surface of said projectile body.

4. A hollow charge subsidiary projectile as defined in claim 1 wherein the interior of said spacer and of said insert are shaped and dimensional such that they can accommodate at least a portion of the rear end of a further subsidiary projectile of like shape.

5. In a hollow charge subsidiary projectile including a projectile body containing a shaped charge having a charge insert with a base adjacent the front end of said body, and a detonator spacer disposed at said front end of said body and normally extending axially forward of said front end of said body for a given predetermined length; the improvement wherein:

said projectile body is composed of at least one layer of a helically wound wire spring with a given number of adjacent wire turns contacting one another and being connected with one another so as to form a closed wall constituting said projectile body; and said detonation spacer is formed by a further given number of adjacent wire turns of said at least one layer of helically wound wire spring which are disposed in a region extending forwardly from a position adjacent said base of said charge insert, and which remain unconnected and thus normally axially spaced, said spacer being delimited at the front of said projectile by the last free wire turn of said further given number of wire turns, whereby said further given number of wire turns of said spring can be compressed to bring said spacer into space saving transporting position.

6. A hollow charge subsidiary projectile as defined in claim 5 wherein said wire of said at least one helically wound layer has a rectangular cross-section.

7. A hollow charge subsidiary projectile as defined in claim 6 wherein said one layer forms the outer peripheral surface of said projectile body.

8. A hollow charge subsidiary projectile as defined in claim 7 wherein the interior of said spacer and of said insert are shaped and dimensional such that they can accommodate at least a portion of the rear end of a further subsidiary projectile of like shape.

* * * * *